US006757943B2

(12) United States Patent
Brown

(10) Patent No.: US 6,757,943 B2
(45) Date of Patent: Jul. 6, 2004

(54) MAIL BAG

(75) Inventor: Barry Brown, Oxfordshire (GB)

(73) Assignee: Royal Mail Group PLC, London (GB)

( * ) Notice: Subject to any disclaimer, the term of this patent is extended or adjusted under 35 U.S.C. 154(b) by 0 days.

(21) Appl. No.: 09/989,893

(22) Filed: Nov. 19, 2001

(65) Prior Publication Data

US 2002/0124360 A1 Sep. 12, 2002

(30) Foreign Application Priority Data

Nov. 17, 2000 (GB) ..... 0028143

(51) Int. Cl.[7] ..... A44B 21/00
(52) U.S. Cl. ..... 24/458; 24/30.5 R; 383/23
(58) Field of Search ..... 24/458, 457, 455, 24/546, 30.5 R, 563, 265 H, 115 H; 220/476; 383/22, 23, 24; 493/226; 211/12

(56) References Cited

U.S. PATENT DOCUMENTS

| | | | | | |
|---|---|---|---|---|---|
| 340,831 | A | * | 4/1886 | Shelby | 24/515 |
| 1,430,824 | A | * | 10/1922 | Martin | 24/599.9 |
| 4,114,925 | A | * | 9/1978 | Burns | 281/45 |
| 4,174,554 | A | * | 11/1979 | Flantua | 24/30.5 P |
| 4,464,813 | A | * | 8/1984 | Bakker et al. | 24/601.1 |
| 4,523,357 | A | * | 6/1985 | Widditsch | 24/600.9 |
| 4,622,724 | A | * | 11/1986 | Dupre | 24/130 |
| 4,676,535 | A | * | 6/1987 | Mautner | 292/320 |
| 4,691,416 | A | * | 9/1987 | Nakayama et al. | 24/114.9 |
| 5,172,879 | A | * | 12/1992 | Calmettes et al. | 248/74.3 |
| D332,220 | S | * | 1/1993 | Specht et al. | D9/434 |
| 5,487,581 | A | * | 1/1996 | Carmo et al. | 294/137 |
| 5,517,735 | A | * | 5/1996 | Tsai | 24/599.9 |
| 5,611,169 | A | * | 3/1997 | Mayer | 43/44.84 |
| 5,645,353 | A | * | 7/1997 | Linnell et al. | 383/22 |
| 5,758,392 | A | * | 6/1998 | Anscher et al. | 24/599.9 |
| 6,182,824 | B1 | * | 2/2001 | Kolton et al. | 206/278 |
| 6,237,200 | B1 | * | 5/2001 | Rodier et al. | 24/545 |
| 6,243,925 | B1 | * | 6/2001 | Aszody | 24/343 |
| 6,338,463 | B1 | * | 1/2002 | Babitz et al. | 248/317 |

FOREIGN PATENT DOCUMENTS

| | | | |
|---|---|---|---|
| EP | 0523642 A1 | * | 1/1993 |
| FR | 2643343 | * | 8/1990 |
| GB | 2021506 A | * | 12/1979 |

* cited by examiner

*Primary Examiner*—Anthony Knight
*Assistant Examiner*—André L. Jackson
(74) *Attorney, Agent, or Firm*—Knobbe, Martens, Olson & Bear, LLP

(57) ABSTRACT

A hook for a mail bag, the hook including a planar attachment portion for attachment to a mail bag, the attachment portion defining a longitudinal axis; a planar supporting portion extending from the attachment portion in the direction of the longitudinal axis and which is planar with the attachment portion, the supporting portion defining an aperture therethrough; and a retaining portion which extends in the plane of the supporting portion and which partially occludes the aperture of the supporting portion, the retaining portion being resiliently deformable out of the plane of the supporting portion.

10 Claims, 4 Drawing Sheets

MAIL BAG

RELATED APPLICATIONS

This application claims the benefit of application 0028143.6 filed Nov. 17, 2000 in Great Britain.

BACKGROUND OF THE INVENTION

1. Field of the Invention

The invention relates to mail bags, and in particular to hooks for attachment to mail bags for supporting the mail bags in frame fittings.

2. Description of the Related Art

FIG. 1 of the accompanying drawings illustrates, in plan view, a frame 1 for supporting mail bags. The frame 1 is often known as a "drop bag fitting" (DBF) frame, and is usually rectangular or square in plan view. At each internal corner of the frame 1, a locating wire or projection 2 is provided. The locating projections 2 are provided for supporting a mail bag within the frame in such a way that the mail bag is supported in a open position.

FIG. 2 illustrates a mail bag 4 which is suitable for support in the drop bag fitting frame 1 of FIG. 1. The mail bag 4 has a number (in this case 4) of mail bag hooks 5 arranged around its open end. To support the mail bag the hooks 5 are positioned over the locating projections 2 of the frame 1, thereby holding the mail bag 4 in place in the frame.

However, existing designs of mail bag hook 5 are less then ideal. For example, one disadvantage of present designs of hook is that they do not retain the mail bag in place on the locating projections of the frame, particularly before the mail bag is filled with mail. One particular existing design uses horizontal wings which extend along the open edge of the mail bag, which wings engage under the frame 1 to retain the bag 4 in place. However, to release these wings can take a considerable effort and operators sometimes find that the hook section molded to the wing section breaks under the load. This then leaves a sharp end section of plastic which has caused injury to operators.

SUMMARY OF THE INVENTION

Accordingly, it is desirable to provide a mail bag hook which can overcome the drawbacks of the presently considered hooks and that provides secure location of a mail bag on the frame, while still allowing relatively straight forward removal of the hook from the projection.

According to one aspect of the present invention, there is provided a hook for mail bag, the hook comprising a retaining portion for attachment to a region of the mail bag adjacent to an open end thereof, the retaining portion extending substantially perpendicular to the open end of the mail bag, and a suspension ring which extends from the retaining portion and defines an aperture through which a locating projection can be inserted, wherein the hook is provided with a resilient potion which extends in the aperture of the hook, such that in use, the portion is deflected.

According to another aspect of the present invention, there is provided a hook for a mail bag, the hook comprising a planar attachment portion for attachment to a mail bag, the attachment portion defining a longitudinal axis, a planar supporting portion which extends from the attachment portion in the direction of the longitudinal axis and which is planar with the attachment portion, the supporting portion defining an aperture therethrough, and a retaining portion which extends in the plane of the supporting portion and which partially occludes the aperture of he supporting portion, the retaining portion being resiliently deformable out of the plane of the supporting portion.

DETAILED DESCRIPTION OF THE PREFERRED EMBODIMENT

Figure 1:
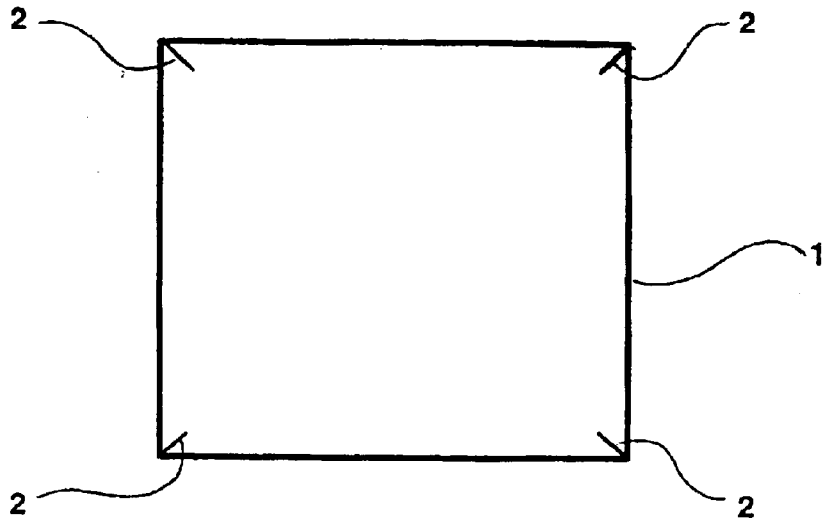
FIG. 1 illustrates a prior art drop bag fitting (DBF) frame.
Figure 2:
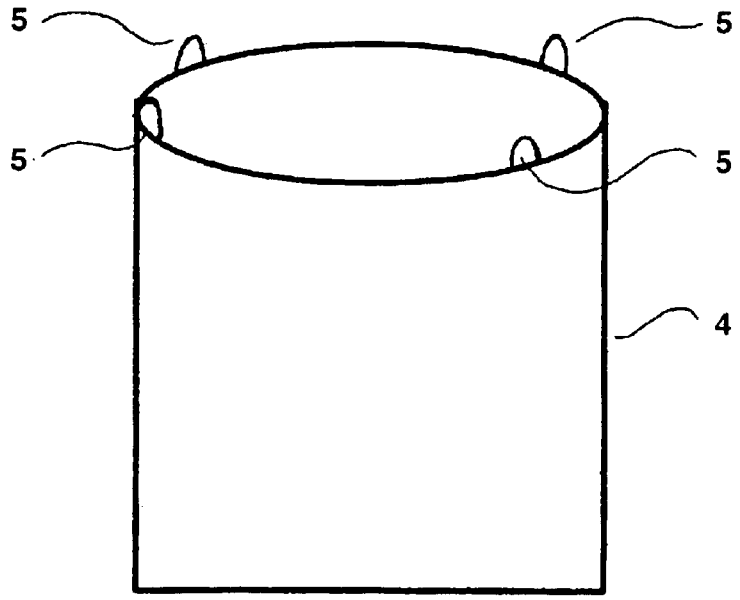
FIG. 2 illustrates a prior art mail bag.
Figure 3:
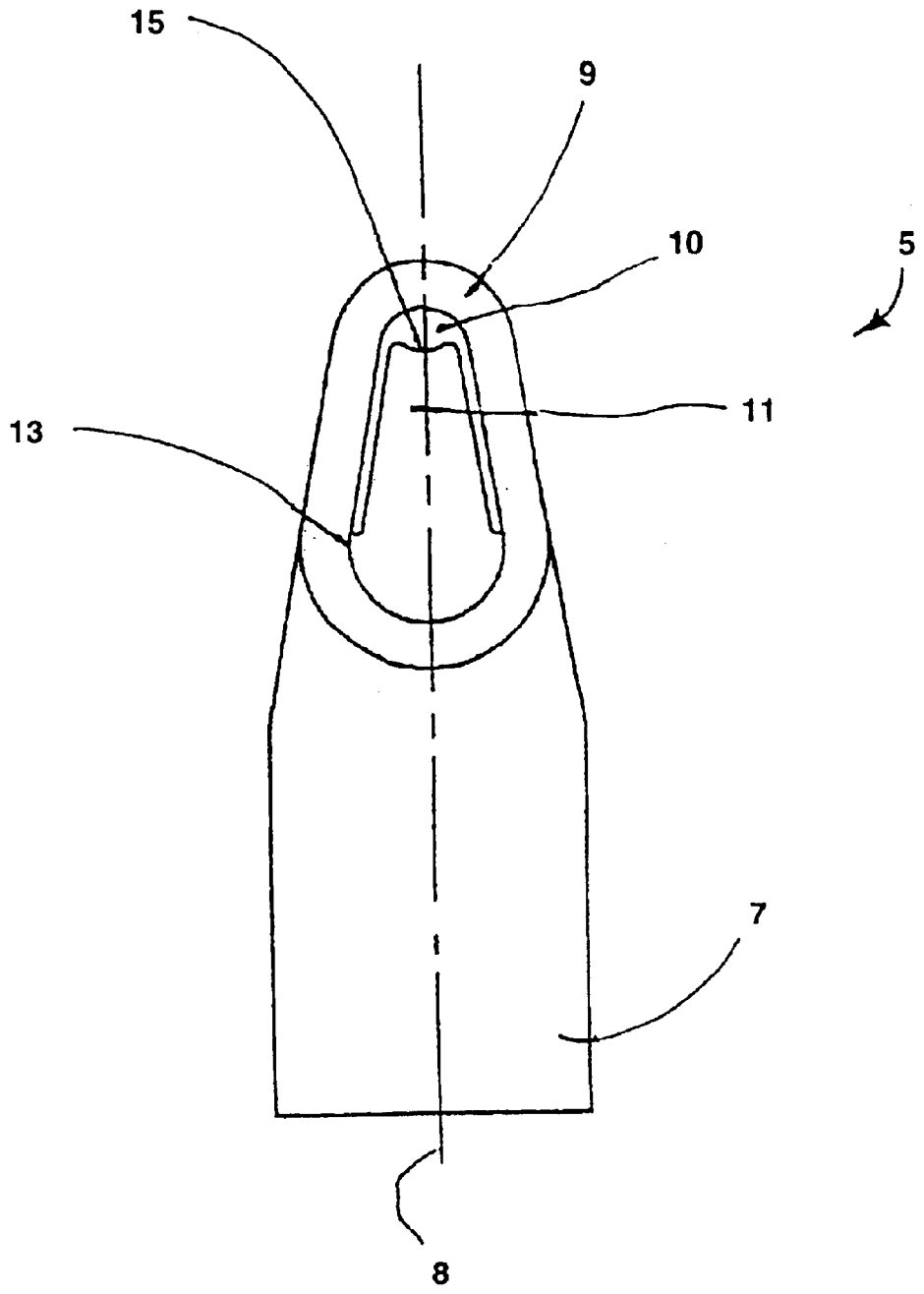
FIG. 3 illustrates a mail bag hook embodying one aspect of the invention.

FIG. 3 illustrates a mail bag hook 5 embodying the present invention. The hook 5 is generally planar (as can be more clearly seen in FIG. 4) and extends along a longitudinal axis 8. In the embodiment of FIG. 3, the hook 5 is symmetrical about the longitudinal axis 8. The hook 5 is attached to a mail bag 4 by stitching an attachment portion 7 to an edge of the mail bag 4 at its open end. In use, the hook 5 is arranged so that the longitudinal extends substantially perpendicular to the edge of the mail bag 4.

The hook 5 also includes a supporting portion 9 which extends in the direction of the longitudinal axis 8 from the attachment portion 7. This supporting portion 9 extends away from the end of the mail bag 4 when the hook 5 is attached thereto. The supporting portion 9 defines an aperture 10 through which a compoundly curved locating projection 2 of the frame 1 can be inserted.

The hook 5 also includes a retaining portion 11 which partially extends across the aperture 10. The retaining portion 11 is resiliently deformable, such that it can bend out of the plane of the hook 5 about a hinge point 13. The retaining portion 11 has a curved top profile 15 which engages with the locating projections 2 of the frame 1 when the hook 5 is in use.

Figure 4:
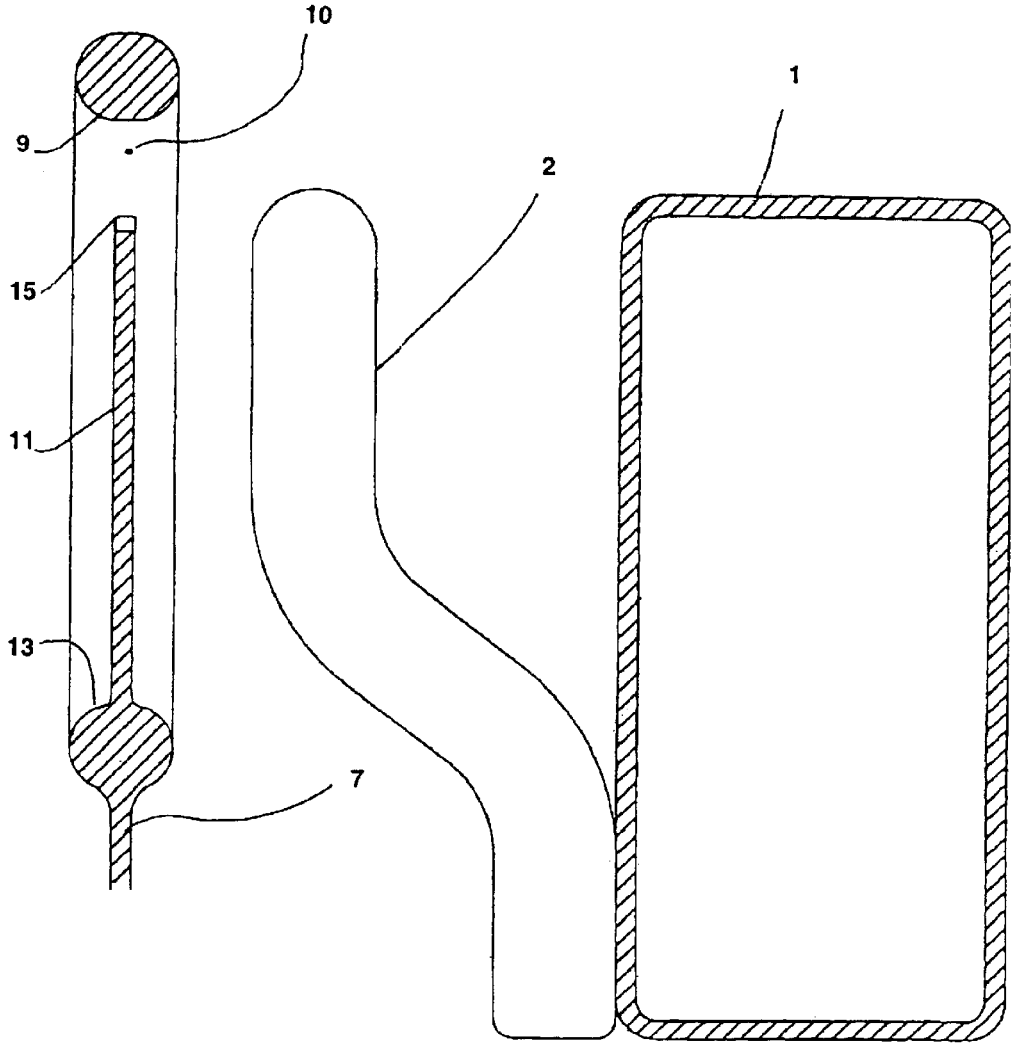
FIG. 4 illustrates the hook of FIG. 3 prior to attachment to the frame of FIG. 1.

FIG. 4 illustrates a cross sectional view of a hook 5 and a locating projection 2 mounted on the frame 1, prior to attachment of the hook 5 to the projection 2. It will be more clear for FIG. 4 that the hook 5 in this unstressed, undeformed state is planar, with the retaining portion 11 being within the supporting portion 9.

Figure 5:
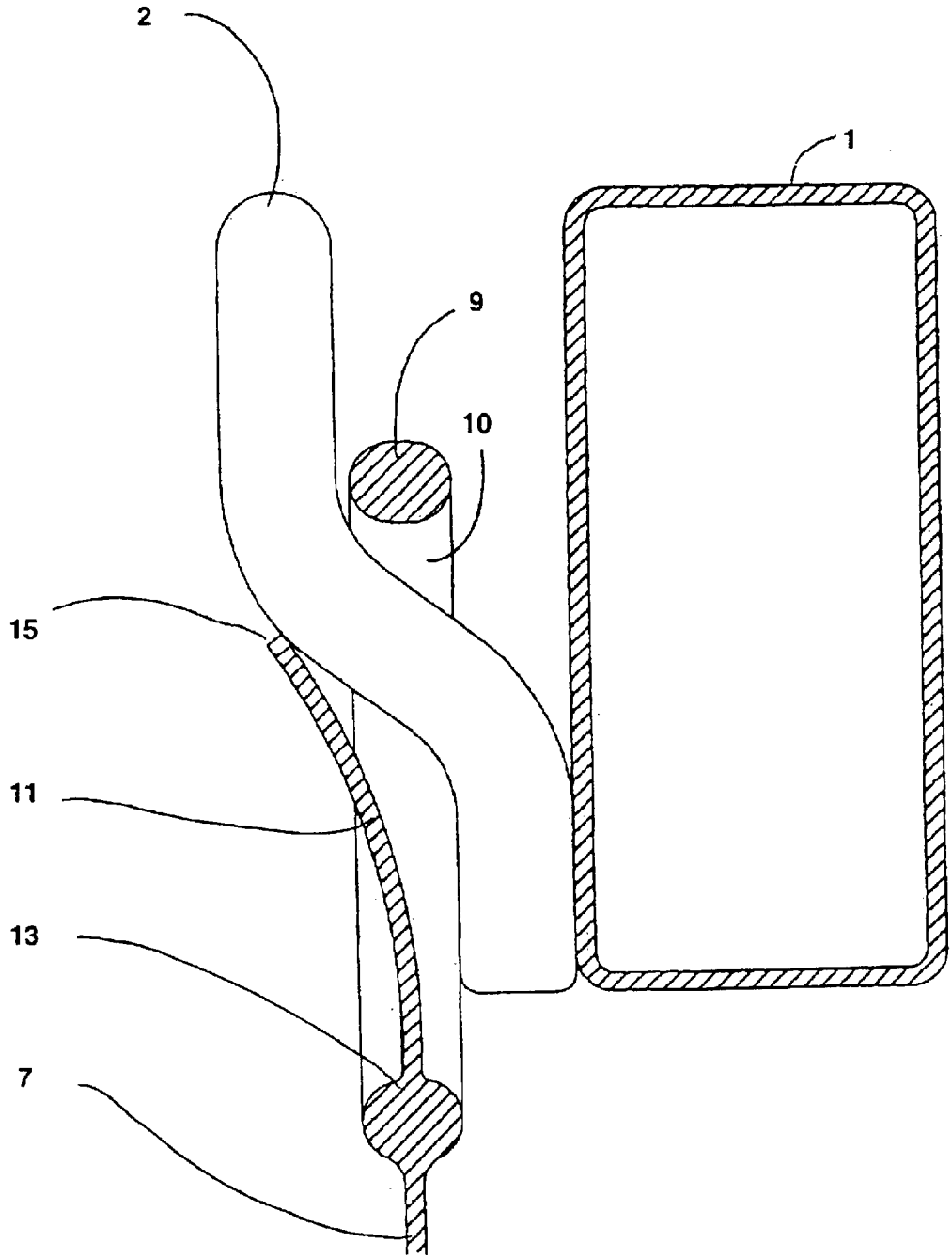
FIG. 5 illustrates the hook of FIG. 3 attached to the frame of FIG. 1.

FIG. 5 illustrates the hook 5 attached to the projection 2 on the frame 1. In order to attach the hook 5 to the projection 2, the hook 5 is placed over the projection 2 such that the projection 2 extends through the aperture 10 of the hook 5. The projection 2 bends or deforms the retaining portion 11 of the hook 5 out of the plane of the hook 5 as illustrated in FIG. 5. The resilience of the retaining portion 11 presses its curved top profile 15 against the underside of the projection 2 so as to hold the hook 5 in place against the projection 2 in a first stressed condition. It can be seen that displacement of the hook 5 from the projection 2 while maintaining the generally vertical alignment of FIGS. 4 and 5 induces the retaining portion 11 into greater, second stressed conditions. This aspect of the invention inhibits the hook 5 from being inadvertently lifted from the projection 2. However, the resilience of the retaining portion 11 is such that only a relatively small applied force is required to lift the hook 5 from the locating projection 2 when required.

It will therefore be appreciated that the hook 5 embodying the invention can overcome the disadvantages of the presently-used mail bag hook.

What is claimed is:

1. A mail bag assembly comprising a mail bag having an edge region defining an open end of the bag and a plurality of hooks, each hook comprising:

a planar attachment portion for attachment to the mail bag, the attachment portion defining a longitudinal axis;

a planar supporting portion which extends from the attachment portion in a direction of the longitudinal axis and which is generally coplanar with the attachment portion, the supporting portion defining an aperture therethrough; and a retaining portion which extends in a plane of the supporting portion and which partially occludes the aperture of the supporting portion, the retaining portion being resiliently deformable out of the plane of the supporting portion wherein the longitudinal axis of each hook is substantially perpendicular to the edge region of the bag.

2. The assembly of claim 1, wherein the supporting portion defines a continuous boundary around the aperture.

3. The assembly of claim 1, wherein the supporting portion is elongate and extends from a base portion connected with the attachment portion to a tip portion, thereby defining an elongate aperture.

4. The assembly of claim 3, wherein the retaining portion extends from the base portion towards the tip portion.

5. A mail bag hook for removably attaching a mail bag to a mail bag support, the support including locating projections, the mail bag hook comprising:

an attachment portion for fixed attachment to the mail bag, the attachment portion extending in a plane;

a co-planar supporting portion which extends from the attachment portion in the same plane, the supporting portion defining an aperture therethrough; and a resilient retaining portion which extends substantially coplanar with the supporting portion in an unstressed condition, so as to partially occlude the aperture of the supporting portion, said resilient retaining portion being resiliently deformable away from the plane of the supporting portion under applied force such that, in an attached condition at least one of the locating projections passes through the aperture to attach the resilient retaining portion to the support, the retaining portion being in a first stressed condition wherein movement of the assembly to a detached condition while maintaining general alignment of the assembly along the vertical axis induces greater second stressed conditions so as to inhibit displacement of the assembly from the mail bag support.

6. The mail bag hook of claim 5, wherein the supporting portion defines a continuous boundary around the aperture.

7. The mail bag hook of claim 5, wherein the supporting portion is elongate and extends from a base portion connected with the attachment portion to a tip portion, thereby defining an elongate aperture.

8. The mail bag hook of claim 7, wherein the retaining portion extends from the base portion towards the tip portion.

9. A mail bag hook assembly adapted for removably attaching a mail bag having an edge to a mail bag support, the support including compoundly curved locating projections, the assembly comprising:

an attachment portion adapted for fixed attachment to the mail bag, the attachment portion extending along a generally vertical axis so as to extend substantially perpendicular to the edge of the mail bag;

an annular supporting portion which extends from the attachment portion generally along the vertical axis and which is generally coplanar with the attachment portion, the supporting portion defining an aperture therethrough; and a resilient retaining portion which extends in a plane of the supporting portion so as to partially occlude the aperture of the supporting portion and, in an unstressed condition, to extend substantially coplanar with the supporting portion and so as to be resilient deformable out of the plane of the supporting portion under applied force such that, in an attached condition, the retaining portion is in a first stressed condition and wherein movement of the assembly to a detached condition while maintaining general alignment of the assembly along the vertical axis induces greater second stressed conditions so as to inhibit displacement of the assembly from the mail bag support.

10. A mail bag hook assembly attached to a mail bag having an edge for removable attachment to a mail bag support, the support including locating projections, the assembly comprising:

an attachment portion attached to the mail bag, the attachment portion extending upwardly, and away from the edge of the mail bag;

a supporting portion which extends from the attachment portion, the supporting portion defining an aperture therethrough; and a resilient retaining portion above the edge of the bag partially occluding the aperture of the supporting portion in an unstressed condition, said resilient retaining portion being resiliently deformable away from the plane of the supporting portion under applied force such that, in an attached condition, the retaining portion is in a first stressed condition and wherein movement of the assembly to a detached condition while maintaining general alignment of the assembly along the vertical axis induces greater second stressed conditions so as to inhibit displacement of the assembly from the mail bag support.

* * * * *